US007833573B2

(12) United States Patent
Boschert et al.

(10) Patent No.: US 7,833,573 B2
(45) Date of Patent: Nov. 16, 2010

(54) METHOD FOR PRODUCING THERMOSENSITIVE RECORDING MATERIAL AND RECORDING MATERIAL PRODUCED ACCORDING TO SAID METHOD

(75) Inventors: Michael Boschert, Appenweier (DE); Georg Streif, Renchen-Erlach (DE)

(73) Assignee: Papierfabrik August Koehler AG, Oberkirch (DE)

( * ) Notice: Subject to any disclaimer, the term of this patent is extended or adjusted under 35 U.S.C. 154(b) by 669 days.

(21) Appl. No.: 11/629,944

(22) PCT Filed: Jun. 10, 2005

(86) PCT No.: PCT/EP2005/006246

§ 371 (c)(1),
(2), (4) Date: Sep. 26, 2007

(87) PCT Pub. No.: WO2005/123411

PCT Pub. Date: Dec. 29, 2005

(65) Prior Publication Data

US 2008/0269047 A1 Oct. 30, 2008

(30) Foreign Application Priority Data

Jun. 17, 2004 (DE) ..... 10 2004 029 261

(51) Int. Cl.
*B05D 3/12* (2006.01)
*B41M 3/12* (2006.01)
*B41M 5/30* (2006.01)

(52) U.S. Cl. ..... 427/152; 427/366; 503/200

(58) Field of Classification Search ..... None
See application file for complete search history.

(56) References Cited

U.S. PATENT DOCUMENTS 4,865,939 A * 9/1989 Usami et al. ..... 430/138
5,068,133 A * 11/1991 Matsumoto et al. ..... 427/358

FOREIGN PATENT DOCUMENTS

DE 197 15 345 A1 10/1998
DE 101 57 690 C1 2/2003
EP 1 593 778 A1 11/2005

* cited by examiner

*Primary Examiner*—Bruce H Hess
(74) *Attorney, Agent, or Firm*—Fay Sharpe LLP

(57) ABSTRACT

The invention relates to a method for producing thermosensitive recording material, comprising a carrier substrate and a thermal reaction layer containing a color former and a color developer. According to the invention, an application suspension, containing the starting materials of the thermal reaction layer, is applied to the carrier substrate and the carrier substrate is subsequently dried with the applied application suspension. Then the dried carrier substrate with the applied thermal reaction layer is guided through a smoothing mechanism in order to be smoothed, wherein the dried carrier substrate with the applied thermal reaction layer is pressed extensively against a roller by means of a predetermined contact pressure. The invention also relates to a recording material which is produced according to the inventive method.

15 Claims, No Drawings

METHOD FOR PRODUCING THERMOSENSITIVE RECORDING MATERIAL AND RECORDING MATERIAL PRODUCED ACCORDING TO SAID METHOD

Invention relates to a method for producing thermosensitive recording material. Moreover, the invention relates to a thermosensitive recording material which is produced by said method.

Thermosensitive recording materials have long been known in the state of the art. They generally present a thin, flat carrier substrate as well as a thereon applied thin thermal reaction layer. Traditionally, paper, and paper containing a portion of synthetic fibers or also an appropriate plastic film serve as carrier substrate. The thin thermal reaction layer applied to the carrier substrate contains in extremely fine distribution a color former, for example crystal violet lactone, and a color developer, for example in form of a sour reaction partner. The color former and color developers are dispersed in a binding agent which does not melt or melts to only minor degree under the effect of heat.

During the thermal print process, a print head of a thermal printer directly acts upon the thermosensitive thermal reaction layer, with the thermal effect producing extensive melting and a diffusion of the color formers and color developers contained in the binding agent, which react with each other while changing color. The binding agent, however, for the most part, remains unchanged in form of a fixed matrix. The discoloration reaction between the color former and the color developer in the thermal reaction layer occurs, during this step, within a fraction of a second, only at the heated location.

Despite high precision with which the above described thermosensitive recording materials are produced, there continues to occur with thermosensitive recording materials to more or less significant extent, the so-called mottling effect. This involves morphological irregularities on the surface of the thermal reaction layer, which occur in particular only after printing, and which can be recognized by naked eye in form of alternately shining and dull spots irregularly distributed over the surface of the thermal reaction layer.

In order to prevent the earlier described mottling effect, whose creation may have multiple and various causes, different measures are employed in producing the recording material.

One thus first attempts to obtain as uniformly level a surface as possible by utilization of an appropriately high quality carrier substrate, on which is applied the thermal reaction layer. Traditionally, a carrier substrate is used which presents a highly uniform fiber distribution, a uniform surface morphology as well as—viewed across the surface—a large highly uniform absorption capacity. At the same time, the roughness of the surface of the carrier substrate, onto which the thermal reaction layer is applied, is adjusted in such manner during production that the thermal reaction layer is able to firmly adhere to the surface of the carrier substrate.

In addition, an attempt is made to further reduce the mottling effect by high-grade quality starter substances from which the thermal reaction layer is formed. With particularly high quality thermosensitive recording materials, the grinding fineness of the particles which constitute the color formers and color developers is adjusted as fine as possible.

The different particles usually have a particle size ranging from 0.5 to 3.5 μm. Moreover, by appropriate measures, a dispersion of the different particles which is as uniform as possible is adjusted in the application suspension forming the subsequent thermal reaction layer.

In addition, one attempts by means of the employed binding agents and the binding agent distribution in the application suspension to reduce the occurrence of the earlier described mottling effect. Also with use of appropriate methods, by means of which the application suspension is applied onto the carrier substance, one strives to obtain a distribution as uniform as possible on the surface of the carrier substrate for the subsequently resulting thermal reaction layer. To that end, various methods are employed, for example the curtain-coating method, the application of rollers or blades or also the so-called spread-coating method. Finally, one attempts to obtain by means of appropriate drying methods a highly uniform thermal reaction layer.

In addition, the recording materials are, furthermore, smoothed after drying on order to adjust a highly homogeneous, smooth but dull surface. For that purpose, it is customary to transport the carrier substrate with applied thermal reaction layer through a smoothing mechanism after drying. One usually employs as smoothing mechanism a so-called Mol smoothing unit (Matt-Online-Smoothing Works). This involves a pair of rollers, between which is passed the carrier substrate with applied thermal reaction layer. The rollers are formed, for example, of metal. Alternatively, however, pairs of rollers can also be employed where one of the two rollers is equipped with a paper covering, a plastic covering or a rubber covering, while the other roller is manufactured, for example, of surface-annealed steel or chilled casting. If appropriate, pairs of rollers are also used where the cover areas of the two rollers are elastically deformable.

It has also been shown that the raw material, for example, which is used for producing the carrier substrate, likewise has a definite effect on the creation of the mottling effect. For instance, the type of cellulose, the adhesive and the pigments of the raw paper material all have an influence upon the properties of the carrier substrate produced from same and, consequently upon the adhesive capacity and homogeneity of the thermal reaction layer applied onto the carrier substrate.

Even though these earlier described different factors and measures are known, thus far, even with the best of starter conditions it has not been possible to obtain constant quality of recording material with constant insignificant tendency toward development of the mottling effect.

Starting from said state of the art, it is now the object of the invention to specify a method for producing a thermosensitive recording material and/or a recording material produced by the invention-specific method, by the employment of which and/or for which the earlier described mottling effect in comparison with known recording materials occurs only to a reduced extent.

A significant characteristic, on which the invention-specific method is based, is the utilization of a so-called runner calendar. A runner calendar is a smoothing mechanism, comprising a roller, usually made of surface-annealed steel and an elastic contact covering, serving as pressing element, said contact covering moving—like the roller—along with the carrier substrate, when the carrier substrate is passed through the gap between the roller and the contact covering. The contact covering has the shape of a hollow cylinder, it is pivotably positioned at its open ends and is pressed, with the air of a so-called pressure runner against the oppositely arranged transported roller. To that end, a hydraulic cushion is usually designed between the interior circumferential area of the contact covering and the pressure runner, by means of which the contact covering is pressed as evenly as possible against the entrained roller. This type of runner calendars are usually only employed in the production of cardboard boxes in order to prevent compression of cardboard boxes, wherein the runner calendars smooth out the surfaces of the cardboard boxes before they are fitted with the to be printed outer layers.

It turned out, surprisingly, with the invention-specific use of the runner calendar for thermosensitive recording material that the thermal reaction layer of recording materials smoothed out with the aid of the runner calendar when compared with recording materials which had been smoothed out in the traditional manner, the former showed a clearly lesser tendency for developing any mottling effect, as was impressively documented by various test series. The recording material showed a uniformly dull surface, which, after printing, also tended to insignificantly, if at all, indicate any mottling effect.

It has also been shown that the influence of the qualities of the starter materials, in particular the influence of the quality of the raw materials and the influence of the quality of the carrier substrate clearly diminishes the mottling effect by application of the invention-specific method, so that even with fewer high-grade starter materials it is possible to produce high-grade recording materials, where there is barely any indication of the mottling effect.

These and further benefits of the invention-specific method, as well as the invention-specific recording material become still more apparent from the description which follows, as well as from the sub-claims.

Accordingly, in a preferred variation of the invention-specific method, it is suggested that the contact pressure, with which the dried carrier substrate with applied thermal reaction layer is pressed against the roller, is adjusted in such manner that any potentially occurring pre-reaction of the thermal reaction layer becomes negligibly minor or does not occur at all. Based on these measures there is assurance that the finished recording material, after being passed through the runner calendar, will not show any color veil caused by pre-reaction of the color formers and color developers in the thermal reaction layer, for example a gray veil, but that instead the recording material presents its desired basic color, for example white. The contact pressure, however, in turn has been selected high enough that sufficient surface smoothness exists with concurrent desired dullness.

It is, moreover, of benefit if both, the transport speed of the carrier substrate through the runner calendar, the contact pressure with which the carrier substrate with applied thermal reaction layer is pressed again the roller, and also the effective contact surface with which the carrier substrate is pressed against the roller during the smoothing-out procedure, are fine-tuned to each other in such manner that it is possible to produce high surface-quality recording material. The transport velocity, the contact pressure and the effective contact surface are preferably selected in such fashion that the thermal reaction layer on the carrier substrate will be heated only to the extent, while passing through the runner calendar, that there will be no visible color-change reactions as yet in the thermal reaction layer. The maximum permissible temperature with traditional thermosensitive recording material lies within a range of approximately 60 to 70° C., where there does not as yet set in any visible color-change reaction of the thermal reaction layer. With specialty papers, where color-change reactions occur only with clearly higher temperatures, for example, in the range of 130 to 170° C., one can, in particular, additionally increase the contact pressure in order to achieve as smooth a surface as possible. By application of this method, it is possible to closely adjust the three process parameters to each other, namely the transport velocity, the contact pressure and the effective contact surface by involvement of the color-change reaction of the thermal reaction layer, so that with lowest color-change degree, one can adjust for high quality of the recording material.

The transport velocity of the carrier substrate through the runner calendar in a preferred variation of the method lies in the range of approximately 700 to 1750 m/min. With such transport velocities there is, on the one hand, the assurance that the thermal reaction layer will not present any of the earlier described color-change reactions, but that, on the other hand, the recording material can, however, be produced at sufficiently high production speed.

The line load of the runner calendar, i.e. the burden of the carrier substrate in the runner calendar, which acts along a contact line across the transport direction of the carrier substrate, lies preferably in a range of approximately 40 N/mm to 650 N/mm. Accordingly, it has been shown that most of the reaction partners in the thermal reaction layer will be heated only at a higher effective line load by the high contact pressures to a degree that a color-change reaction will occur.

In order to smooth the carrier substrate as carefully as possible, the nip-width of the runner calendar, i.e. the length viewed in transport direction of the carrier substrate, along which the roller and the contact covering make contact with the carrier substrate, is selected in such manner that the nip-width lies, given a sheet width of the carrier substrate of 3500 to 4500 mm, in the range of 30 to 50 mm. As a result of the clearly greater nip width of the runner calendar, compared with the state of the art,—in the state of the art it lies within a range of 2 to 4 mm, it is possible to adjust the maximally effective contact pressure of the invention-specific method comparatively low, since the recording material is smoothed in the runner calendar over a longer period of time.

In order to assure adequate elasticity of the carrier substrate with applied thermal reaction layer during the smoothing procedure in the runner calendar, the carrier substrate with applied thermal reaction layer is dried immediately prior to being smoothed only to the extent that the degree of moisture of the carrier substrate with applied thermal reaction layer lies in the range of 4 to 8% by weight.

In order to achieve highly homogeneous properties over the entire width of the carrier substrate before the smoothing step in the runner calendar, it is further suggested in a particularly preferred method variation, to once again moisturize the dried carrier substrate with applied thermal reaction layer on its reverse side facing away from the thermal reaction layer and to dry the moistened carrier substrate with applied thermal reaction layer to the desired degree of humidity prior to being smoothed in the runner calendar.

The application suspension forming the subsequent thermal reaction layer is preferably applied onto the carrier substrate by means of spreading. To that end, the most diverse known methods can be used, for example application of suspension via spread-coating. with the aid of rollers or cylinders or also with the aid of so-called "blaids". Another spreader method by means of which the application suspension is applied onto the carrier substrate is the so-called curtain-coating method. In this method, the carrier substrate is passed through a curtain-coating fixture in which the application suspension is applied in the form of a curtain or veil on the surface of the carrier substrate, whereby the application suspension, due to its surface tension, uniformly distributes itself on the surface to be coated.

In order to obtain a particularly uniform distribution of the application suspension and particularly uniform adhesion of the thermal reaction layer to be formed on the carrier substrate, it is, moreover, of particular benefit if the carrier substrate is definitely smoothed, preferably immediately prior to the application of the application suspension that is to subsequently form the thermal reaction layer. This results in the carrier substrate obtaining a uniformly homogenized surface, offering excellent adhesion when the suspension is applied.

In order to obtain a highly uniform distribution of the thermal reaction layer on the flat carrier substrate, it is suggested relative to a particularly preferred variation of the invention-specific method, that in a pre-programmed process step an intermediate layer by means of which the rough surface of the carrier substrate is leveled and homogenized, be applied on the surface of the carrier substrate, onto which the thermal reaction layer is to be applied. By mixing of appropriate additives, the intermediate layer can be adjusted in targeted fashion in such manner, that is serves at the same time as thermal isolation between the carrier substrate and the thermal reaction layer applied on the intermediate layer. As a result of said thermal isolation effect, the color-change reaction is additionally accelerated inasmuch as the thermal volume produced under pressure by, the thermal print head on the thermal reaction layer is, in turn, reflected back by the intermediate layer into the thermal reaction layer, while—if any at all—an insignificant portion of the charged thermal volume is transferred to the carrier substrate and radiated to the outside by same.

In order for the application suspension which will subsequently form the thermal reaction layer to also uniformly distribute itself over the surface to be coated when an additional intermediate layer is employed, it is suggested here as well that the carrier substrate with applied intermediate layer be additionally smoothed down prior to application of the subsequently forming application suspension, for example by means of a conventional Mol-calendar.

The carrier substrate, which usually involves a paper- or plastic plane, can either have been produced in advance and conducted, for example, in the form of rolls to the equipment executing the invention-specific method. It is, however, of particular benefit to produce the recording material online on a single machine. To that end, the carrier substrate of known raw materials is already produced, dried, pressed and smoothed on the same equipment, and subsequently transported to the corresponding fixtures for application of the intermediate layer and/or for application of the application suspension forming the later thermal reaction layer.

Alternatively, it is also conceivable to produce the carrier substrate immediately prior to application of the intermediate layer or prior to application of the application suspension forming the later thermal reaction layer, but on separate equipment from the equipment which executes the invention-specific method, so that the equipment for application of the intermediate layer or the thermal reaction layer can optimally be adjusted in its process parameters, in particular the transport velocity. Production of the carrier substrate immediately prior to application of the intermediate layer or prior to application of the application suspension forming the later thermal reaction layer has the advantage that online already during production of the carrier substrate, the properties of the carrier substrate can be adjusted in targeted fashion and, if necessary, re-adjusted in order to be able to produce a high quality thermosensitive recording material.

A paper plane preferably serves as carrier substrate. Alternatively, however, it is also possible to utilize a plastic film or also a paper plane with a percentage of synthetic fibers as carrier substrate.

In accordance with another aspect, the invention concerns a thermosensitive recording material with a carrier substrate and also a thermal reaction layer comprising a color former and a color developer. The thermosensitive recording material is preferably produced by a method as related in the different earlier described method variations.

Particularly preferred is that the thermal reaction layer of the invention-specific recording material be applied on the carrier substrate by the curtain-coating method. In particular, utilization of the curtain-coating method has the advantage that the recording material can be produced with very high production speed, and, secondly, the possibility exists of particularly fine and targeted dosing and development of the thermal reaction layer.

The paper weight of the finished recording material lies preferably in the range of 45 to 120 g/m$^2$.

The brightness or the white contents of the finished recording material lies in case white recording material is involved, in the range of 85 to 98%, measured according to ISO 2469.

In the following, the invention is explained in more detail using an example, with the basic concept of the invention not being limited to said example.

EXAMPLE

First, a paper plane was produced as carrier substrate on a traditional paper production machine and an intermediate layer was applied. Then the thusly produced paper plane was passed to the fixture for application of the thermal reaction layer.

The aqueous application suspension which will subsequently form the thermal reaction layer was applied onto the carrier substrate with the aid of the curtain coating method. The viscosity of the aqueous application suspension amounted to 450 mPas (according to Brookfield, 100 R/min, 20° C.). The surface tension of the application suspension was 46 mN/m (static ring method). The basis weight of the paper plane was at 43 g/m$^2$. The paper plane was passed through the curtain-coating fixture with a transport velocity of 1200 m/min. There, an aqueous application suspension was applied in known fashion in order to develop a thermal reaction layer having a weight of 5.8 g/m$^2$ (oven-dry).

Following application of the aqueous application suspension, the drying process of the coated paper plane took place in the usual manner. Subsequently, the flat side opposite the hardened thermal reaction layer was again moistened and dried to the extent that the moisture contents of the paper plane with dried thermal reaction layer was at approximately 7% by weight, the objective being to adjust via the entire width of the paper plane optimum constant material properties of the paper plane.

After that, the thus coated and in its moisture contents definitely adjusted paper plane with applied thermal reaction layer was passed through a runner calendar, and the velocity was here also at 1200 m/min. The runner calendar was a runner calendar made by the Voith® Company in form of a "shoe" calendar. The runner calendar which was employed in the test facility of Voith® involved a calendar which was equipped with a roller made of chilled casting and a pressure shoe unit. The chilled casting roller had a diameter of 1067 mm. The pressure shoe unit was formed by a contact covering made of elastomer with a diameter of 1100 mm, which was retained at a retainer device by means of rotatable tension rings. In the interior of the cylindrical contact covering was arranged a pressure shoe, which was to be operated hydraulically and by means of which it was possible to form between the contact covering and the pressure shoe a hydrostatic press zone.

The paper plane which was coated with the thermal reaction layer was subsequently passed through the smoothing gap of the runner calendar, whereby the contact pressure by means of which the contact covering was pressed against the other roller, was adjusted in such fashion that the result was a maximum line load of 600 N/mm and a minimum line load of 50 N/mm. The nip width which depends upon the size of the pressure shoe was set to 40 mm with a plane width before the calendar of 800 mm.

After passing through the runner calendar, the thus coated and smoothed-down paper plane was rolled up.

The table which follows shows parameters of various thermosensitive recording materials produced according to the invention-specific method in comparison with recording materials which were produced in the usual manner.

It turned out, contrary to previously held assumptions that only with sufficiently high contact pressure can an optimally smooth surface be achieved with the thermal reaction layer of a thermosensitive recording material, that with the aid of the runner calendar at clearly lower contact pressure and clearly longer dwell time of the recording material in the smoothing gap of the runner calendar, it is possible to adjust a uniform, possibly even better surface quality without occurrence of pre-reactions. At the same time, the recording material produced according to the invention-specific method showed clearly fewer mottling effects than the thermosensitive recording material produced according to the traditional method.

| | Optical Pre-reaction | Optical | | Brightness according | |
|---|---|---|---|---|---|
| No. | Density 1 | Density 2 | Contents | to Bekk | Smoothness |
| 100 | 1.40 | 0.86 | 92.4 | 157 | 0 |
| 101 | 1.41 | 0.92 | 91.5 | 285 | 0.5 |
| 102 | 1.38 | 1.00 | 91.1 | 315 | 1 |
| 103 | 1.38 | 1.02 | 90.5 | 336 | 1.5 |
| 1.04 | 1.39 | 1.00 | 90.2 | 346 | 2 |
| 105 | 1.39 | 1.02 | 90.0 | 358 | 2.5 |
| 201 | 1.40 | 0.90 | 91.8 | 252 | |
| 202 | 1.40 | 0.93 | 91.7 | 260 | 0.5 |
| 203 | 1.40 | 0.93 | 91.1 | 269 | 0.5 |
| 204 | 1.39 | 0.94 | 91.1 | 275 | 0.5 |
| 205 | 1.40 | 0.94 | 91.2 | 279 | 1 |
| 300 | 1.41 | 0.86 | 93.0 | 167 | 0 |
| 301 | 1.40 | 0.90 | 92.4 | 236 | 0 |
| 302 | 1.41 | 0.93 | 92.2 | 267 | 0 |
| 303 | 1.40 | 0.94 | 92.0 | 295 | 0 |
| 304 | 1.41 | 0.96 | 92.1 | 311 | 0 |
| 305 | 1.40 | 0.96 | 92.0 | 328 | 0 |
| 306 | 1.40 | 0.99 | 91.6 | 334 | 0 |

The above table lists recording materials of differing thermal sensitivity, which have been flattened according to different methods. The optical density 1 and optical density 2, the brightness, smoothness were measured according to Bekk as well as the pre-reactions.

The samples marked with 100 and 300 were not flattened.

The samples marked with 101 to 105 were flattened in a calendar comprising a roller with hard surface and a roller with elastic surface, having a Shore-hardness of 90° Sh (D).

The samples marked with 201 to 206 were flattened in a calendar having two rollers whose surfaces were respectively elastic and had a Shore-hardness of 90° Sh (D).

The samples marked with 301 to 306 were flattened according to the invention with the previously described runner calendar.

As can be learned from the table, all samples present approximately the same values for optical density 1 and optical density 2, by means of which is indicated how quickly a thermal paper reacts. The optical densities were respectively measured with a remissions-densitometer of the Macbeth D 19 C type, which measures the contrast difference between uncolored measuring surface and measuring surface blackened by thermal effect. The higher the measured value, the more intense is the blackening of the thermosensitive recording material. The optical density 1 indicates the maximum degree of blackening, which occurs with a given energy actuation (for example obtained by current-sourcing time of 1 milli-second. In order to obtain optical density 2, the thermosensitive recording material is treated under the same conditions, but with application of only half the length of the current-sourcing time.

With respect to the brightness content, which was ascertained according to ISO 2469, one can recognize that with the invention-specific method it is possible to obtain a higher brightness contents than with the traditional flattening methods. Samples which were flattened with the runner calendar show brightness contents of at least 92.0% whereas comparable samples show brightness contents of less than 92.0%, such as, for example, sample 105 with a brightness contents of 90.0%.

The flatness values, measured according to Bekk in seconds with respect to the samples manufactured according to the invention-specific method, corresponded in essence to the usual values of the comparable samples.

One essential difference between the samples produced according to the invention and the samples produced according to traditional methods could, however, be determined by the so-called pre-reaction. It involves a value which indicates whether the thermosensitive recording material presents already minor discoloration reaction after passing through the calendar.

The following statement applies: the higher the value of the pre-reaction, the more clearly a discoloration reaction can be perceived. As can be determined from the table, none of the samples produced according to the invention-specific method showed any pre-reaction (value=0), whereas the comparison samples showed some distinct pre-reactions (values up to 2.5).

In summary it was discernible that the samples that had been produced according to the invention-specific method presented at least the same properties after calendaring as the comparison samples, but had lesser tendency toward pre-reactions.

In addition, the samples produced according to the invention-specific method, compared with the samples produced according to the traditional methods presented a duller appearance, which was also retained after passing through a pressure step, and there was almost no mottling effect.

The invention claimed is:

1. A method for producing thermosensitive recording material comprising a carrier substrate as well as a thermal reaction layer comprising a color former and a color developer, in particular for producing a thermal paper, whereby during the method a suspension is applied to the carrier substrate containing the starter material for the thermal reaction layer, the carrier substrate with applied suspension is dried and passed through a smoothing mechanism for smoothing purposes, characterized in that the dried carrier substrate with applied thermal reaction layer is passed for smoothing purposes through a shoe calender, in which the dried carrier substrate with applied thermal reaction layer is pressed extensively against a roller by means of a pre-determined contact pressure, and wherein the dried carrier substrate with applied thermal reaction layer, before being smoothed in the shoe calendar, is moistened on the back, remote from the thermal reaction layer, and the moistened carrier substrate and the applied thermal reaction layer are additionally dried before being smoothed in the shoe calender.

2. A method according to claim 1, characterized in that the contact pressure by means of which the dried carrier substrate with applied thermal reaction layer is pressed against the roller is adjusted in such manner that any possibly occurring pre-reaction of the thermal reaction layer is negligibly small or does not occur.

3. A method according to claim 1, characterized in that the transport speed of the carrier substrate through the shoe calender, the contact pressure by means of which the carrier substrate with applied thermal reaction layer is pressed against the roller, as well as the effective contact surface is selected in such manner that the thermal reaction layer on the carrier substrate while passing through the shoe calender is only heated up to such degree so that there will be no visible discoloration reaction of the thermal reaction layer.

4. A method according to claim 1, characterized in that the transport speed of the carrier substrate lies in the range of 700 to 1750 m/min.

5. A method according to claim 1, characterized in that the load distributed over the length of the shoe calender lies in the range of 40 N/mm to 650 N/mm.

6. A method according to claim 1, characterized in that the nip-width of the shoe calender, with a sheet width of the carrier substrate of 3500 to 4500, lies in the range of 30 to 50 mm.

7. A method according to claim 1, characterized in that the moisture contents of the carrier substrate with applied thermal reaction layer, immediately prior to passing through the shoe calender, lies in the range of 4 to 8% by weight.

8. A method according to claim 1, characterized in that the application suspension is applied on the carrier substrate by means of coating.

9. A method according to claim 1, characterized in that the suspension is applied to the carrier substrate by using the curtain-coating method.

10. A method according to claim 1, characterized in that the carrier substrate is smoothed prior to application of the suspension forming the subsequent thermal reaction layer.

11. A method according to claim 1, characterized in that the carrier substrate is equipped with an intermediate layer onto which the suspension is applied.

12. A method according to claim 11, characterized in that the intermediate layer is likewise applied as suspension on the carrier substrate and the carrier substrate with applied intermediate layer is dried before application on the intermediate layer of the suspension forming the future thermal reaction layer.

13. A method according to claim 11, characterized in that the carrier substrate with applied intermediate layer is smoothed prior to application of the suspension forming the future thermal reaction layer.

14. A method according to claim 11, characterized in that the carrier substrate is produced immediately prior to application of the intermediate layer and/or prior to application of the suspension forming the future thermal reaction layer.

15. A method according to claim 11, characterized in that a paper sheet serves as carrier substrate.

* * * * *